US006601328B1

(12) United States Patent
Benaquista et al.

(10) Patent No.: US 6,601,328 B1
(45) Date of Patent: Aug. 5, 2003

(54) SIGN ASSEMBLY

(75) Inventors: Vincent F. Benaquista, Delmont, PA (US); Shaun P. Blackham, Delmont, PA (US)

(73) Assignee: IDL Incorporated, Pittsburgh, PA (US)

( * ) Notice: Subject to any disclaimer, the term of this patent is extended or adjusted under 35 U.S.C. 154(b) by 0 days.

(21) Appl. No.: 10/371,691

(22) Filed: Feb. 22, 2003

Related U.S. Application Data

(62) Division of application No. 09/886,503, filed on Jun. 21, 2001.

(51) Int. Cl.[7] ..... G09F 7/02

(52) U.S. Cl. ..... 40/611; 40/607; 40/606; 248/218.4

(58) Field of Search ..... 40/611, 661.03, 40/489, 618, 490, 620, 649, 651, 606, 607, 612; 403/353; 248/218.4

(56) References Cited

U.S. PATENT DOCUMENTS

| | | | | | |
|---|---|---|---|---|---|
| 1,768,715 | A | | 7/1930 | Hopp | |
| 1,942,444 | A | * | 1/1934 | O'Connor | 40/592 |
| 2,345,913 | A | * | 4/1944 | Bishop | 40/606 |
| 2,627,683 | A | | 2/1953 | Leander | |
| 3,552,702 | A | * | 1/1971 | Springer | 248/316.7 |
| 3,838,529 | A | | 10/1974 | Aybar | |
| 4,548,377 | A | * | 10/1985 | Huel | 248/219.1 |
| 4,742,633 | A | * | 5/1988 | Snediker | 40/607 |
| 4,783,921 | A | * | 11/1988 | George | 40/602 |
| 4,882,866 | A | | 11/1989 | Gebhardt | |
| 4,884,352 | A | | 12/1989 | Lipscomb | |
| 5,335,889 | A | * | 8/1994 | Hopkins et al. | 248/231.81 |
| 6,023,867 | A | * | 2/2000 | Gagne | 40/491 |
| 6,233,858 | B1 | * | 5/2001 | Brach et al. | 40/660 |
| 6,293,035 | B1 | * | 9/2001 | LaPointe | 40/607 |

* cited by examiner

*Primary Examiner*—William L. Miller
(74) *Attorney, Agent, or Firm*—Ronald S. Lombard

(57) ABSTRACT

A sign assembly particularly useful for point of purchase displays is provided. The sign assembly provides an easily changeable sign portion, but when mounted remains securely in position. The sign assembly may utilize pre-existing structures for its support.

7 Claims, 3 Drawing Sheets

SIGN ASSEMBLY

RELATED APPLICATION

This application is a divisional of and claims the benefit of U.S. application Ser. No. 09/886,503 filed Jun. 21, 2001, which application is incorporated herein by reference in its entirety.

BACKGROUND OF THE INVENTION

The present invention relates to a sign assembly, and, in particular, to a sign assembly including a sign portion that may be quickly installed in the assembly and, once installed, remains securely in place until its removal is desired.

Typically, such sign assemblies include a frame structure often made of metal or plastic or the like, where a sign portion is held in place by the frame structure. Very often such frame structures do not offer the ease in changing the sign portion and at the same time provide a sign portion that is securely held in place once it is positioned in the sign assembly. Very often such sign assemblies are outside and exposed to the elements, or may be inside and exposed to people or other forces bumping the assembly, for example.

Various sign assemblies have been disclosed in the past, such as, U.S. Pat. No. 1,768,715, dated Jul. 1, 1930, issued to Hermann Hopp, et al., which discloses a display device for displaying price ticket holders. The ticket holders are removable. In one embodiment, the Hopp patent discloses a main body portion of elongated shape. Inwardly disposed end flanges integral with the ends of the main body portion are 3 included. A channel member is carried by the main body portion and extends transversely in spaced relationship with the flanges. The oppositely disposed flanges formed integral with the channel member and are adapted to cooperate with their respective end flanges to retain a ticket in display position in the main portion. Tongues are carried by the channel members and are adapted for bending around the respective side edge of the body portion to retain the price tickets in position.

Other sign assemblies are known in the art such as disclosed in U.S. Pat. No. 2,627,683, dated Feb. 10, 1953, issued to Russell J. Leander, which disclosed a foldable display made of sheet material, preferably paper or cardboard treated to make it waterproof or it may be of other sheet material The Leander patent discloses that the invention is particularly adapted to being applied to the top of an oil pump casing but may have other applications to other casings which are generally rounded on top or at the upper edges. A display made of sheet material which is cut, scored and foldable to conform to a curved support. Means for attaching the ends of the sheet together and thus turning both of the ends of the oval scored base downwardly to conform to oppositely curved surfaces at relatively opposite sides of the top of the supporting structure are included. In one embodiment a resilient means extends through the display and against the scored portion in its outwardly turned position and fastening clips secured to the ends of the resilient means comprising hooks adapted to engage the sides of the support with the rounded top to which the display is attached.

In U.S. Pat. No. 3,838,529, dated Oct. 1, 1974, issued to Areas O. Aybar, is disclosed a nameplate for a directory comprising a strip and blank in which the strip is comprised of a thin, flexible, resilient deformed material having rounded ends forming lobes. The blank being a plastic engraveable blank secured to the strip. Nameplates are provided which are flexible to be bent in a slight curvature and are resilient to return to that shape when flattened. The nameplate is deformed and/or positioned to cause only the strip of the nameplate to fit into and engage folded-over edge portions of a holder.

Another such sign assembly is disclosed in U.S. Pat. No. 4,882,866, dated Nov. 28, 1989, issued to Roland Gebhardt, which discloses a signage system support structure formed from a pair of identical extruded multi-groove channel members. A connecting element is included in the form of an elongated rigid panel inserted into an unconstricted medial groove of each channel which serves to join two channels. Each channel is additionally formed with a constructed medial groove, and a pair of outwardly facing grooves and pair of lateral grooves on each side of and parallel to the medial grooves. In use, the upper and/or lower edges of the sign to be supported are engaged in one or more of the channel grooves with a flat sign having either opposed edges encased in the lateral grooves or a free edge in a constricted medial groove, an arcuate sign having its edges engaged in the outwardly facing grooves. The signs where supported displays may be formed with engaging tabs displaceable from the plane of the sign to engage a groove.

In U.S. Pat. No. 4,884,352 dated Dec. 5, 1989, issued to Robert S. Lipscomb, is disclosed a changeable sign assembly comprising a base with a least two retaining members attached to the base which has walls defining opposing longitudinal grooves. A number of display members having curved opposite edge portions which are formed of a thin resilient material. The edge portions are flexibly deformed by the longitudinal grooves to the retaining members so that the display members are removably retained by the retaining members.

Problems may arise with the prior art sign assemblies in that, outside forces, such as wind, for example, may cause the sign portion of the assembly to become inadvertently dislodged. Thus, there exists a need for a sign assembly that includes a sign portion that may be quickly and easily changed but will not be disturbed by outside forces, such as, wind.

SUMMARY OF THE INVENTION

The present invention provides a sign assembly useful in point of purchase advertising, such as, used in fuel stations, food stores, and the like. The sign assembly of the present invention includes a support member which may, for example, be the top or side of a gasoline pump, display stand, wall, ceiling, or pole. An elongated flange member includes a base portion attached to the support member and an elongated trough portion having a U-shaped cross-section. The trough portion is substantially perpendicular to the base portion. Transverse pin members are mounted in predetermined intervals between opposite walls within the U-shaped trough portion.

A sign member is provided which includes a sign portion where a printed message for advertising and the like may be displayed. The sign member has a lip portion on at least one side thereof. The lip portion is sized to engage the U-shaped trough portion of the flange member. The lip portion has a plurality of pin member receiving openings. Each of the pin member receiving openings of the lip portion have a pin member docking portion engageable with transverse pin members and a pin member locking portion positioned substantially perpendicular to the pin member docking portion. The pin member receiving openings of the lip member and the transverse pin members are in operative alignment.

The sign assembly may be quickly assembled by aligning the pin members of the flange member with the docking portion of the pin member receiving openings of the lip portion of the sign member and pushing on the sign member until the pin member enters the locking portion of the pin member receiving openings. Then the sign member is slid in the direction of the locking portion of the pin member receiving openings to cause the pin members to engage the locking portion of the pin member receiving openings, thereby securing the pin member to the sign member. The support member may be vertical or horizontal.

Preferably, the base member has first mounting apertures passing therethrough in predetermined position. The support member is provided with second mounting apertures therethrough in predetermined position. The support member is threaded proximate the second apertures. First mounting bolts are included. The first mounting bolts are in pass through relationship with the first apertures of the base member in threadable engagement with the second apertures of the support member.

Preferably, the sign assembly further includes a sign secondary securing assembly. The sign secondary securing assembly, preferably includes a secondary securing bolt. The U-shaped trough portion has third mounting apertures passing therethrough. A wing nut member is provided engageable with a secondary securing bolt, whereby when the secondary bolt passes through the third apertures of the U-shaped trough and engages the wing nut member, the sign portion is ensured to remain in a fixed position on the support member despite any external forces.

BRIEF DESCRIPTION OF THE DRAWINGS

For a better understanding of the invention, reference may be had to the accompanying drawings exemplary of the invention in which.

BRIEF DESCRIPTION OF THE PREFERRED EMBODIMENTS

Figure 1:
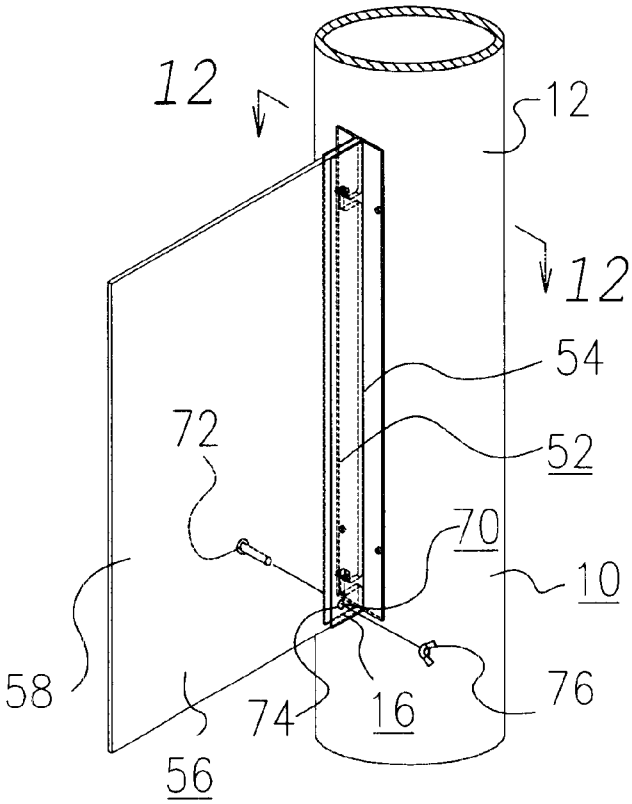
FIG. 1 is a perspective view, partly in section showing the sign assembly utilizing a support member such as a pole.
Figure 2:
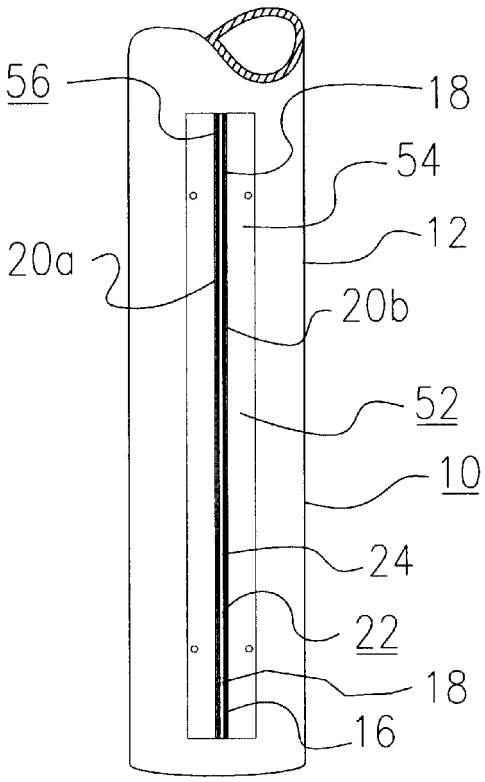
FIG. 2 is a side elevational view of the sign assembly shown in FIG. 1.
Figure 3:
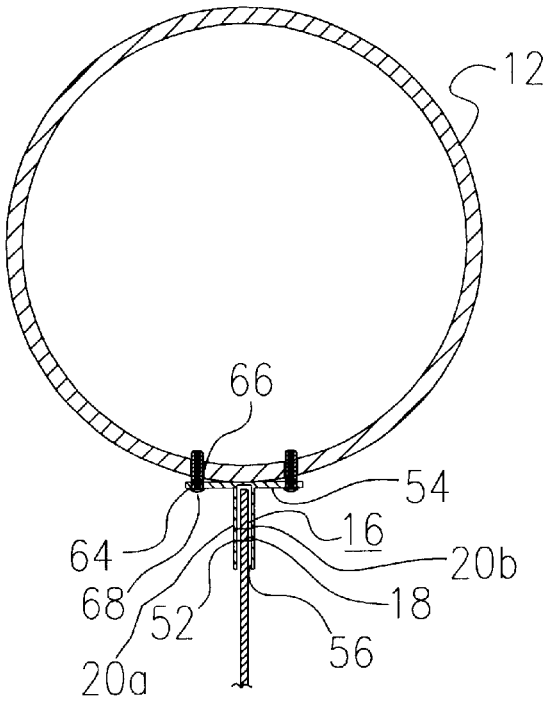
FIG. 3 is a cross-sectional view taken along the line 12—12 of FIG. 1.
Figure 4:
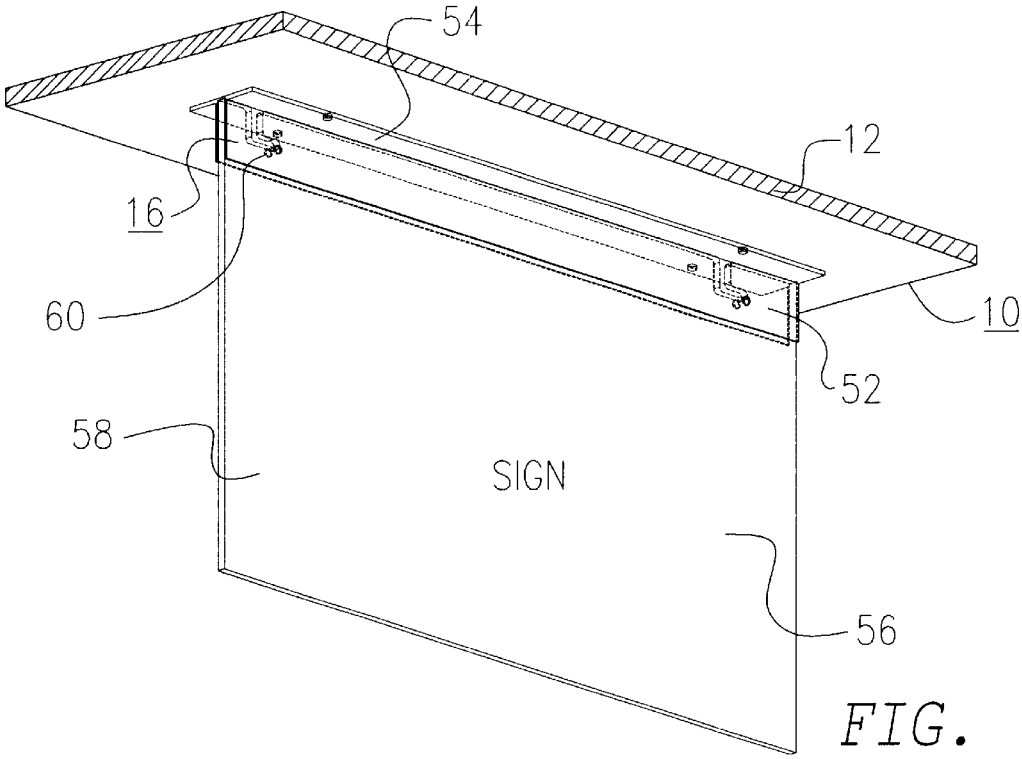
FIG. 4 is a perspective view of the sign assembly showing an overhead support member; and, FIG. 5 is a perspective view of the sign portion of the sign assembly shown in FIG. 4.

With reference to FIGS. 1–4, the sign assembly 10 includes a support member 12, which as shown in FIGS. 1–3 may be a pole, or ceiling, a wall, not shown, or any other structure. An elongated flange member 52 including a base portion 54 attached to the support member 12 and elongated trough portion having a U-shaped cross section 16. The trough portion 16 is substantially perpendicular to the base portion 54 as shown in FIGS. 1–3. Transverse pin members 18 are mounted at predetermined intervals between opposite walls 20*a*, 20*b* within the U-shaped trough portion as shown in FIGS. 2 and 3.

Figure 5:
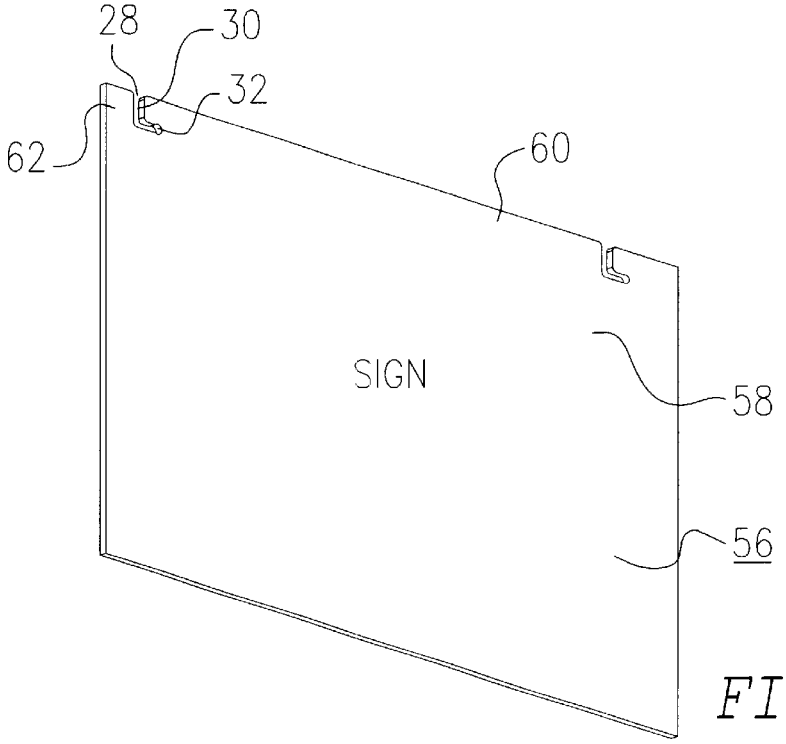

A sign member 56 includes a sign portion 58 which has a lip portion 60 on at least one side 62 thereof. The lip portion 60 is sized to engage the U-shaped trough portion 16 of the flange member 52. The lip portion 60 has a plurablity of pin member receiving openings 28. Each of the pin member receiving openings 28 of the lip portion 60 has a pin member docking portion 30 engageable with the transverse pin members 18 and a pin member locking portion 30 positioned substantially perpendicular to the pin member docking portion as shown in FIG. 5. The pin member receiving openings 28 of the lip portion 60 and the transverse pin members 18 are in operative alignment.

Utilizing the present invention, the sign assembly 10 may be quickly assembled by aligning the pin members 18 of the flange member 52 with the docking portion 30 of the pin member receiving openings 28 of the sign member 56 and pushing on the sign member 56 until the pin member 18 enters the locking portion 32 of the receiving openings 28. The sign member 56 is then slid in the direction of the locking portion 32 of the pin member receiving openings 28 to cause the pin members 18 to engage the locking portions 32 of the pin member receiving openings 28 to cause the pin members 18 to engage the locking portions 32 of the pin member receiving openings 28, thereby securing the sign member 56 to the flange member 52. The sign member 56 is not required to be resilient.

Preferably, the support member 12 may be vertical or horizontal. Preferably, the base portion 54 has first mounting apertures 64 passing therethrough in predetermined position as shown in FIG. 3. The support member 12 is preferably threaded proximate the second mounting apertures 66 not shown in the figures. First mounting bolts or screws 68 are provided in pass through relationship with the first apertures 64 of the base portion 54 in threadable engagement with the second apertures 66 of the support member 12 as shown in FIG. 3. The elongated flange member 52 of the present invention may be made of extruded aluminum, for example, or any other suitable material. The mounting of the flange member 52 as described may instead of mounting bolts in respective apertures, be accomplished by welding which could be utilized assuming the materials are appropriate or any other mounting means.

The sign assembly 10 of the present invention may also preferably further include a sign secondary securing assembly 70 shown in FIG. 1. The sign secondary securing assembly 70 includes a secondary securing bolt 72. The U-shaped trough portion 16 has a third mounting aperture 74. A wing nut 76 is provided and is engageable with the secondary securing bolt 72, whereby the secondary securing bolt 72 passes through the third mounting aperture 74 of the U-shaped trough 16 and engages the wing nut member 76, the sign portion 58 is ensured to remain in a fixed position on support member 12 despite any external forces such as wind or human forces, for example.

What is claimed is:

1. A sign assembly comprising:

a support member, an elongated flange member including a base portion affixed to said support member and an elongated trough portion having a U-shaped cross-section, said trough portion substantially perpendicular to said base portion, transverse pin members mounted at predetermined intervals between opposite walls within said U-shaped trough portion, a sign member including a sign portion and having a lip portion on at least one side thereof, said lip portion having a plurality of pin member receiving openings, each of said pin member receiving openings of said lip portion having a pin member docking portion engageable with said transverse pin members and a pin member locking portion positioned substantially perpendicular to said pin member docking portion, said pin member receiving openings of said lip portion and said transverse pin members in operative alignment, whereby said sign assembly may be quickly assembled by alignment of said pin members with said flange member with said docking portion of said pin member receiving openings of said lip portion of said sign member and pushing on said sign member until said pin member enters the locking portion of said pin member receiving openings and then sliding said sign member in the direction of said locking portion of said pin member receiving openings to cause said pin members to engage the locking portions of said pin member receiving openings, thereby securing said sign member to said flange member.

2. The sign assembly of claim 1, wherein said support member is vertical.

3. The sign assembly of claim 1, wherein said support member is horizontal.

4. The sign assembly of claim 1, wherein said base portion has first mounting apertures passing therethrough in predetermined position.

5. The sign assembly of claim 4, wherein said support member has second mounting apertures therethrough in predetermined position, said support member being threaded proximate said second mounting apertures.

6. The sign assembly of claim 5, further comprising first mounting bolts, said first mounting bolts in pass through relationship with said first mountings apertures of said base portion in threadable engagement with said second mounting apertures of said support member.

7. The sign assembly of claim 1, further comprising a sign secondary securing assembly, said sign secondary securing assembly comprising a secondary securing bolt, said U-shaped trough portion having a third mounting aperture therethrough, a wing nut member engageable with said secondary securing bolt, whereby when said secondary bolt passes through said third mounting aperture of said U-shaped trough and engages said wing nut member, said sign portion is ensured to remain in a fixed position on said support member despite any external forces.

* * * * *